US011306568B2

(12) United States Patent
Leniek, Sr.

(10) Patent No.: US 11,306,568 B2
(45) Date of Patent: Apr. 19, 2022

(54) HYBRID ARTIFICIAL LIFT SYSTEM AND METHOD

(71) Applicant: CT LIFT SYSTEMS, L.L.C., Houston, TX (US)

(72) Inventor: Humberto Leniek, Sr., Houston, TX (US)

(73) Assignee: CTLift Systems, L.L.C, Houston, TX (US)

( * ) Notice: Subject to any disclaimer, the term of this patent is extended or adjusted under 35 U.S.C. 154(b) by 29 days.

(21) Appl. No.: 16/732,662

(22) Filed: Jan. 2, 2020

(65) Prior Publication Data

US 2020/0217180 A1 Jul. 9, 2020

Related U.S. Application Data

(60) Provisional application No. 62/788,026, filed on Jan. 3, 2019.

(51) Int. Cl.
*E21B 43/12* (2006.01)
*E21B 34/08* (2006.01)

(52) U.S. Cl.
CPC ..... *E21B 43/122* (2013.01); *E21B 43/127* (2013.01); *E21B 34/08* (2013.01); *E21B 2200/04* (2020.05)

(58) Field of Classification Search
CPC .. E21B 43/122; E21B 43/127; E21B 2200/04; E21B 34/08
See application file for complete search history.

(56) References Cited

U.S. PATENT DOCUMENTS 1,731,688 A * 10/1929 Stuck ..... F04B 47/00 417/109
4,397,612 A 8/1983 Kalina
4,629,218 A * 12/1986 Dubois ..... E21B 17/20 138/155
4,708,595 A 11/1987 Maloney
5,638,904 A 6/1997 Misselbrook
5,785,500 A 6/1998 Leniek
5,971,069 A 10/1999 Stoy
5,992,521 A 11/1999 Bergren
6,220,358 B1 4/2001 Leniek, Sr.
6,354,377 B1 3/2002 Averhoff
6,502,639 B2 1/2003 Leniek, Sr.
(Continued)

*Primary Examiner* — Nicole Coy
*Assistant Examiner* — Yanick A Akaragwe
(74) *Attorney, Agent, or Firm* — Daniel J. Krueger

(57) ABSTRACT

An improved CT-based artificial lift system illustrates multiple novel aspects, each of which offers reduced installation cost and/or reduced rates of wear and performance degradation. One such aspect arises in a first illustrative well embodiment that includes: a pump tubular that separates an annular conduit from a central bore conduit, with one of the annular conduit and the central bore conduit serving as a lift conduit and the other of the annular conduit and the central bore conduit serving as a gas injection conduit, and with the pump tubular having at least one port for gas to flow from the gas injection conduit to the lift conduit; a downhole pump having a plunger that is driven by reciprocating motion of the pump tubular to force a liquid flow into the lift conduit, the liquid flow receiving lift gas from the at least one port; and a gas control unit that supplies the gas to the gas injection conduit.

14 Claims, 4 Drawing Sheets

(56) References Cited

U.S. PATENT DOCUMENTS

| | | | | |
|---|---|---|---|---|
| 6,585,049 | B2 | 7/2003 | Leniek, Sr. | |
| 6,629,566 | B2 | 10/2003 | Liknes | |
| 6,745,857 | B2 | 6/2004 | Gjedebo | |
| 8,535,024 | B2 * | 9/2013 | Conyers | F04B 47/022 417/430 |
| 8,789,609 | B2 | 7/2014 | Smith | |
| 9,638,000 | B2 * | 5/2017 | Dyck | E21B 41/0078 |
| 9,835,149 | B2 * | 12/2017 | Mills | E21B 43/127 |
| 2004/0065441 | A1 | 4/2004 | Bosley | |
| 2005/0104176 | A1 * | 5/2005 | Rodney | E21B 47/002 257/678 |
| 2006/0045767 | A1 | 3/2006 | Liknes | |
| 2006/0124298 | A1 | 6/2006 | Geier | |
| 2010/0326668 | A1 | 12/2010 | Griffiths | |
| 2010/0326670 | A1 | 12/2010 | Griffiths | |
| 2011/0132593 | A1 * | 6/2011 | Phloi-montri | E21B 43/14 166/54.1 |
| 2011/0214880 | A1 | 9/2011 | Rogers | |
| 2014/0262292 | A1 | 9/2014 | Joseph et al. | |
| 2016/0108709 | A1 * | 4/2016 | Mazzanti | E21B 17/18 166/372 |
| 2016/0230519 | A1 | 8/2016 | Leniek, Sr. | |
| 2016/0298432 | A1 * | 10/2016 | Leniek, Sr. | E21B 43/129 |
| 2018/0266190 | A1 * | 9/2018 | Nielsen, Jr. | E21B 17/042 |
| 2020/0165908 | A1 * | 5/2020 | El-Mahbes | E21B 43/127 |

* cited by examiner

FIG. 1A
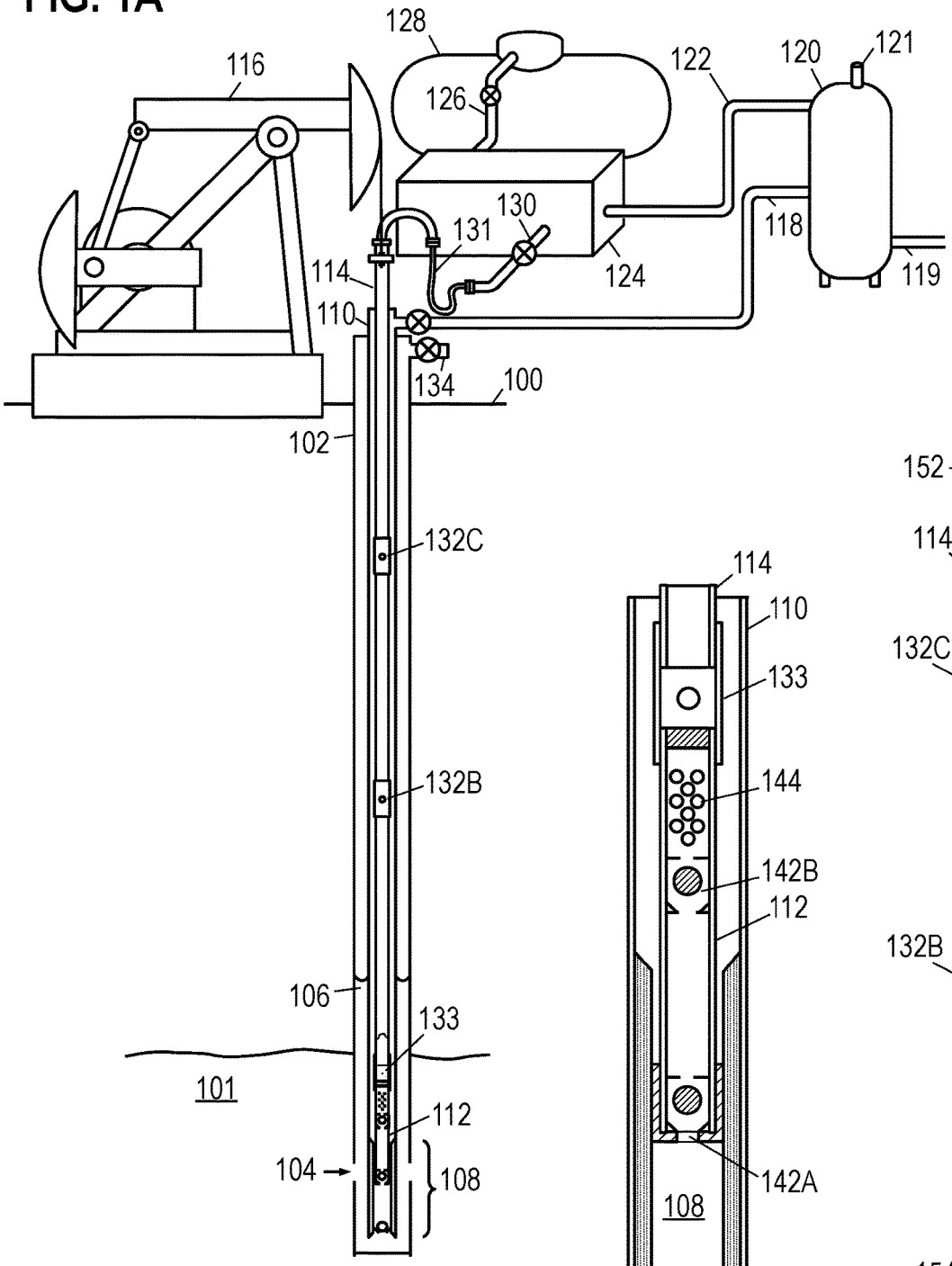
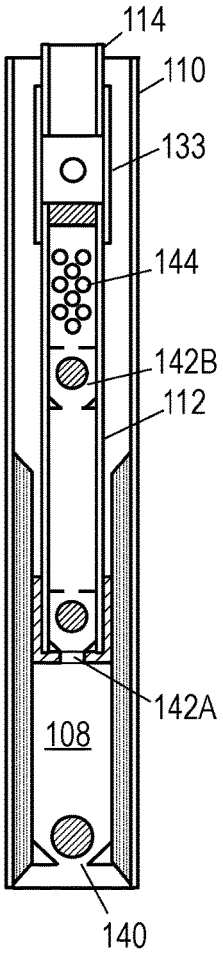
FIG. 1B
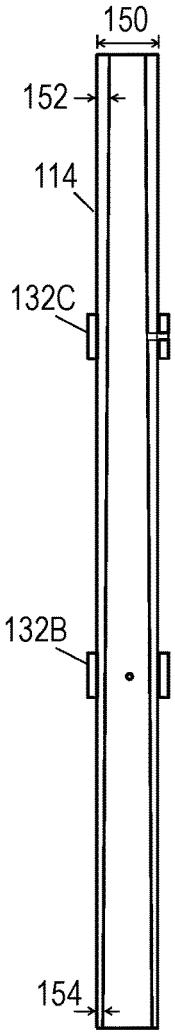
FIG. 1C

FIG. 2A
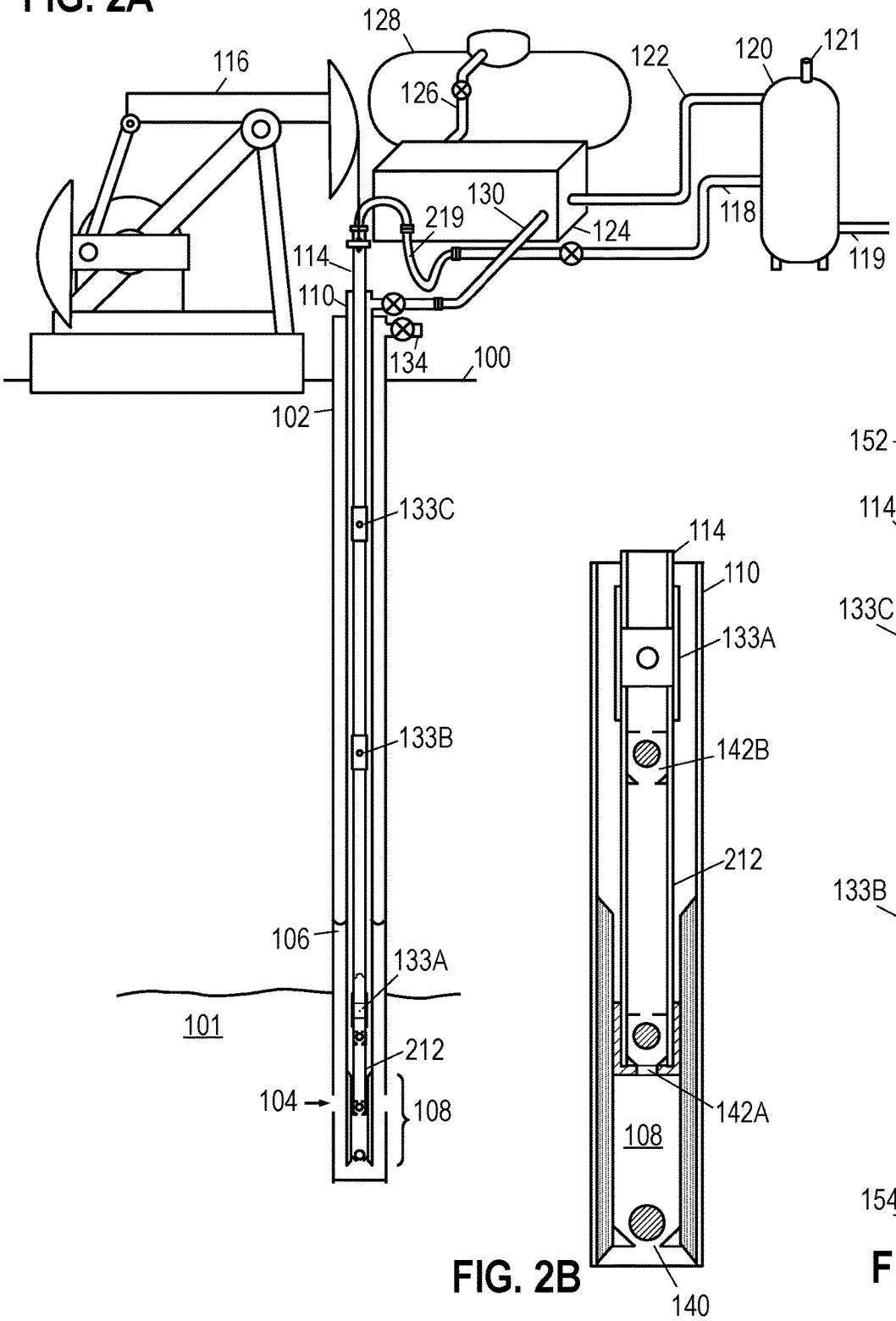
FIG. 2B
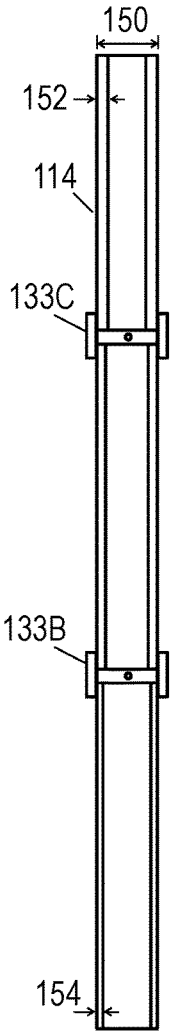
FIG. 2C

HYBRID ARTIFICIAL LIFT SYSTEM AND METHOD

CROSS REFERENCE TO RELATED APPLICATIONS

The present application claims priority to Provisional U.S. Application 62/788,026, filed 2019 Jan. 3 by inventor Humberto Leniek, Sr.

BACKGROUND

Two types of tubing are popular in oil wells: threaded tubing and continuous tubing. Continuous tubing may also be called "coil tubing", "coiled tubing", and for non-metallic embodiments, "composite tubing", and in any of these cases it may be abbreviated as "CT". Threaded tubing consists of fixed lengths of pipe with threaded ends that allow the threaded tubing to be coupled together to form a tubing string. On the other hand, CT is a long, continuous pipe which is unwound from a spool as it is fed into the well. For particularly deep wells, multiple such continuous lengths may be joined end-to-end, typically using roll-on or slip-type connectors though other connection types are known and may be used (e.g., welding). While each tubing type has its advantages, CT is generally regarded as more economical, and can generally be used in smaller diameters, with fewer connections, than threaded tubing.

Hydrocarbon reservoirs are generally formed by traps in the geologic structure where the less buoyant ground water is displaced by rising hydrocarbons. When these reservoirs are first accessed, the fluid in the rock pores generally enters the well with sufficient pressure to carry the fluids to the surface. However, depending on the rate at which fluids are produced, this pressure generally falls over time, reducing the natural "lift" in the well and making the well unable to continue producing at an adequate rate on its own. (The natural lift can also be inhibited by the accumulation of dense fluids that create a large hydrostatic pressure in the wellbore.) To address these issues, oil producers have developed "artificial lift", a term that covers a wide variety of techniques for conveying fluid to the surface.

There exist a number of proposals for CT-based artificial lift systems including, e.g., U.S. Pat. No. 5,785,500 "Well pump having a plunger in contact with well and pump fluid"; U.S. Pat. No. 6,220,358 "Hollow tubing pumping system"; U.S. Pat. No. 6,502,639 "Hollow tubing pumping system"; U.S. Pat. No. 6,585,049 "Dual displacement pumping system suitable for fluid production from a well"; US2010/0326668 "Position monitoring facility"; US2010/0326670 "Lift wash-through facility"; US2016/0230519 "Liquified gas-driven gas-lift system"; and US2016/0298432 "Liquified gas-driven production system". These references are hereby incorporated herein by reference in their entireties. Such systems offer significant economic advantages for gas and oil well drilling and production, yet there remains opportunity for further cost reduction and enhanced production longevity.

SUMMARY

Accordingly, there is disclosed herein an improved CT-based artificial lift system illustrating multiple novel aspects, each of which offers reduced installation cost and/or reduced rates of wear and performance degradation. At least one such aspect arises in a first illustrative well embodiment that includes: a pump tubular that separates an annular conduit from a central bore conduit, with one of the annular conduit and the central bore conduit serving as a lift conduit and the other of the annular conduit and the central bore conduit serving as a gas injection conduit, and with the pump tubular having at least one port for gas to flow from the gas injection conduit to the lift conduit; a downhole pump having a plunger that is driven by reciprocating motion of the pump tubular to force a liquid flow into the lift conduit, the liquid flow receiving lift gas from the at least one port; and a gas control unit that supplies the gas to the gas injection conduit.

There is also disclosed an illustrative hybrid artificial lift method embodiment that includes: anchoring a pump body downhole at the end of a production tubular in a well; attaching a pump plunger to a pump tubular, the pump tubular having a central bore; providing the pump tubular with one or more gas injection ports; positioning the pump tubular within the production tubular, thereby defining an annular conduit; reciprocating the pump tubular to drive the pump plunger within the pump body and thereby create a fluid flow to a well head via the central bore or the annular conduit; and concurrently with said reciprocating, injecting gas into the fluid flow via the one or more gas injection ports.

Another illustrative method embodiment includes attaching an insertable pump to a pump tubular, the pump tubular having a central bore; providing the pump tubular with one or more gas injection ports; positioning the pump tubular within the production tubular, thereby defining an annular conduit; anchoring a body of the insertable pump to the production tubing; reciprocating the pump tubular to drive a pump plunger within the pump body and thereby create a fluid flow to a well head via the central bore or the annular conduit; and concurrently with said reciprocating, injecting gas into the fluid flow via the one or more gas injection ports.

Another novel aspect arises in a second illustrative well embodiment that includes: a production tubular terminated by a pump body anchored downhole; a tapered continuous tubing string positioned inside the production tubular and terminated by a plunger; and a surface pump unit that reciprocates the tapered continuous tubing string to reciprocate the plunger in the pump body, thereby pumping fluid to a well head via a bore of the tapered continuous tubing string or via an annular conduit between the production tubular and the tapered continuous tubing string.

There is also disclosed an illustrative an artificial lift method embodiment that includes: anchoring a pump body downhole at the end of a production tubular in a well; attaching a pump plunger to a pump tubular that comprises a tapered continuous tubing string with a central bore; positioning the pump tubular within the production tubular, thereby defining an annular conduit; reciprocating the pump tubular to drive the pump plunger within the pump body and thereby create a fluid flow to a well head via the central bore or the annular conduit.

Yet another novel aspect arises in a third illustrative well embodiment that includes: a continuous tubing string that defines a central bore conduit and an annular conduit, the continuous tubing string having multiple continuous tubing portions connected end-to-end by one or more continuous tubing gas lift couplers, each coupler having one or more gas injection ports.

There is also disclosed an illustrative artificial lift method embodiment that includes: inserting a production tubular into a well, the production tubular being terminated by a check valve; positioning a first portion of a continuous tubing string in the production tubular; connecting a continuous tubing gas lift (CTGL) coupler to the first portion of the continuous tubing string, the CTGL coupler having a gas injection port; connecting a second portion of the continuous tubing string to the CTGL coupler; positioning the second portion of the continuous tubing string in the production tubular, the continuous tubing string defining a central bore conduit and an annular conduit, with one of the annular conduit and the central bore conduit serving as a lift conduit and the other of the annular conduit and the central bore conduit serving as a gas injection conduit; and injecting gas via the gas injection conduit and the gas injection port, thereby providing gas lift to a fluid flow in the lift conduit.

Each of the disclosed embodiments may further include one or more of the following optional features in any suitable combination: 1. the central bore conduit is the lift conduit and the annular conduit is the gas injection conduit. 2. the central bore conduit is the gas injection conduit and the annular conduit is the lift conduit. 3. a production tubular within which the pump tubular reciprocates. 4. the pump tubular comprises multiple continuous tubing portions connected by one or more continuous tubing gas lift couplers, each coupler providing at least one port for gas to flow from the gas injection conduit to the lift conduit. 5. at least one port comprises a hole drilled through a wall of the pump tubular and a fitting or tubing sleeve that defines a chosen orifice size for the port. 6. the central bore conveys the fluid flow to the well head and the annular conduit conveys gas to the one or more injection ports. 7. the central bore conveys gas to the one or more injection ports and the annular conduit conveys the fluid flow to the well head. 8. the tapered continuous tubing string has a smoothly tapered wall thickness. 9. the tapered continuous tubing string includes multiple continuous tubing portions coupled end-to-end by one or more continuous tubing couplers, each continuous tubing portion having a fixed wall thickness ordered from thicker to thinner with increasing depth. 10. each gas injection port is threaded to receive a nozzle or fitting that defines a chosen orifice size for the port. 11. each of the one or more continuous tubing gas lift couplers comprises roll-on or slip-type connectors. 12. the continuous tubing string is reciprocated to drive fluid into the lift conduit.

BRIEF DESCRIPTION OF THE DRAWINGS

FIG. 1A is a schematic overview of an illustrative hybrid artificial lift system with annular production.

FIG. 1B is a cross-section of an illustrative downhole hollow tubing pump providing annular production.

FIG. 1C is a cross-section of an illustrative hollow pump rod with a smoothly tapered wall thickness.

FIG. 2A is a schematic overview of an illustrative hybrid artificial lift system with central bore production.

FIG. 2B is a cross-section of an illustrative downhole tubing pump providing central bore production.

FIG. 2C is a cross-section of an illustrative hollow pump rod with a step-tapered wall thickness.

Figure 3:
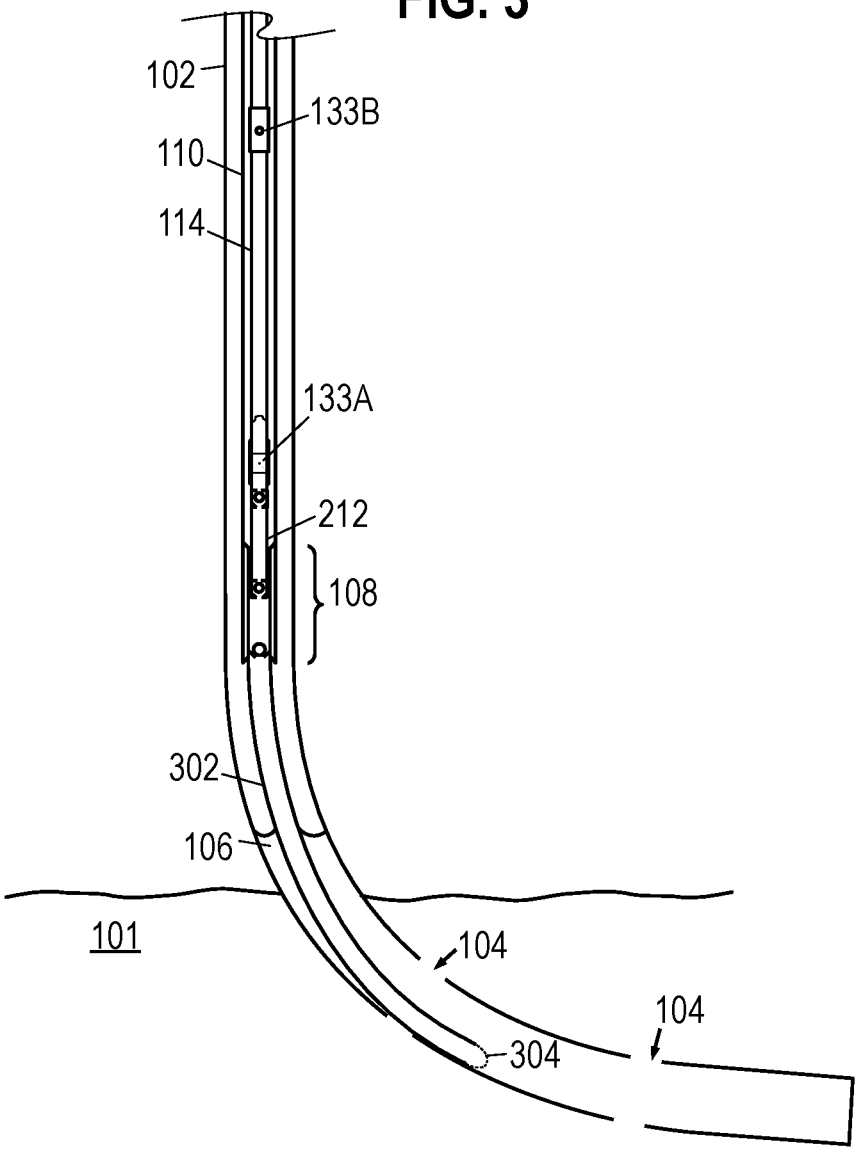
FIG. 3 is a schematic view of an illustrative deviated well employing a dip tube.

It should be understood, however, that the specific embodiments given in the drawings and detailed description do not limit the disclosure. On the contrary, they provide the foundation for one of ordinary skill to readily discern the alternative forms, equivalents, and modifications that are encompassed within the scope of the appended claims. Please note that the figures are not drawn to scale, as such drawings would make certain features difficult to perceive. Rather, certain dimensions are distorted and unequally exaggerated to aid the reader's understanding of how the system is intended to function.

Nomenclature

In the following description, the term "fluid" is employed for liquids, gases, and mixtures thereof, whether or not they may be laden with solid particulates. The term "tubular" is employed as a generic term for piping of every sort that might be found in an oil, gas, or water well, including continuous tubing and strings of threaded tubing with regular or premium threads. The term tubular applies to small and large diameter tubing whether employed as drill pipe, casing, production tubing, or service strings. "Conduit" is employed as a generic term for any of the various tubular-defined fluid flow passages including the central bore of a tubular or the annular space around an inner tubular that is perhaps defined with the help of an outer tubular.

DETAILED DESCRIPTION

FIG. 1A shows a first illustrative hybrid artificial lift system. A well has been drilled from the Earth's surface 100 to intersect a fluid reservoir 101. The well is generally lined with casing 102 that extends from the well head downward into the fluid reservoir 101. Though the well is shown as a straight vertical hole, it may in practice deviate from the vertical and extend for quite some distance in a horizontal direction, in some cases following a tortuous trajectory. At one or more positions along its length, the casing tubular 102 may be perforated to allow fluid 104 to flow into the casing 102 and form a pool of liquid 106. A pump body 108 is affixed to the lower end of a production tubular 110 and lowered to be submerged in the liquid 106 pooling at the bottom of the well. The production tubular may be a threaded tubing string or continuous tubing. The pump body 108 is preferably anchored downhole using a standard tubing anchor, and the production tubular is 110 secured to a well head at the surface 100.

A pump plunger 112 is affixed to the bottom of a pump tubular 114 (aka "hollow pump rod") and lowered through the interior of the production tubing string 110 until it is properly seated in pump body 108. A packing unit (not specifically shown) at the top of the production tubular 110 seals the gap between the production tubular 110 and the pump tubular 114, but allows for vertical movement of the pump tubular 114. (A polished sleeve may be placed over the pump tubular to form a durable low-friction seal with the packing unit.) A surface pump unit 116 reciprocates (cyclically raises and lowers) the pump tubular 114, thereby reciprocating the plunger 112 in the pump body 108. The surface pump unit 116 of FIG. 1A employs a "walking beam" pump configuration to reciprocate the pump tubular 114, but alternative pump configurations are known and may be suitable for imparting reciprocating motion to the pump tubular (including, e.g., hydraulic pumping units) in the disclosed systems. As discussed in greater detail below, the reciprocation of the plunger 112 forces fluid upward through the annular space between the production tubular 110 and the pump tubular 114, until the fluid reaches the surface 100 and passes through outflow pipe 118, through a vertical gas separator 120, and to a storage tank through fluid outlet 119. The storage tank stores the produced liquid.

A pressure relief valve 121 prevents excessive pressure buildup in the separator 120, but so long as the pressure of the produced gas remains at safe levels, a return line 122 carries the gas to a gas control unit 124, which preferably compresses the gas for storage and reuse. A gas supply line 126 couples the gas control unit 124 to a gas storage tank 128. In some contemplated embodiments, the gas storage tank stores compressed natural gas (CNG). At least some contemplated embodiments additionally or alternatively store liquified natural gas (LNG). Other contemplated embodiments store compressed and/or liquified nitrogen, carbon dioxide, propane, air, or other gas mixtures. In some contemplated embodiments, the storage tank may be supplemented by, or replaced with, a transport pipeline for conveying gas to or from the well site.

Gas control unit 124 supplies recovered and compressed gas, supplemented as necessary from gas storage tank 128, via inflow pipe 130 to the center bore of pump tubular 114. To accommodate its reciprocating motion, pump tubular 114 is shown coupled to the inflow pipe 130 via a gooseneck and flexible high-pressure hose 131, but other suitable configurations may also be employed. The compressed gas travels into the well via the pump tubular 114. One or more ports or nozzles in the pump tubular 114 permit the compressed gas to enter the annular conduit between the pump tubular 114 and production tubular 110. The gas creates bubbles in the flow of liquid along the annular conduit, increasing flow velocity while also reducing the liquid density. In addition to reducing the force and energy required for each pump stroke, the gas lift is expected to make the temperature profile of the well more gradual, thereby reducing deposition and scaling and other effects that might degrade pumping efficiency over time.

To provide the gas lift ports, the pump tubular 114 illustrated in FIG. 1A includes two continuous tubing gas lift (CTGL) sleeves 132B, 132C and a CTGL coupler 133 spaced along its length. The sleeves 132 may be half-sleeves that attach to each other (e.g., in a hinged, pinned, snapped, bolted, or other fashion) around the pump tubular to secure themselves in place. One or more holes may be drilled through the pump tubular wall before or after the sleeves are attached. The sleeves preferably provide orifices, nozzles, or other apertures that align with the drilled hole(s) and can be configured to different orifice sizes to set each port's relative or absolute gas flow rates for a given pressure drop. Conversely, the coupler secures the pump tubular to the plunger 112, providing a gas flow port therebetween. As with the sleeves, the coupler preferably includes orifices, nozzles, or other apertures that can be configured to different orifice sizes to set the port's relative or absolute gas flow rates for a given pressure drop. The sleeve and coupler ports may be configured without moving parts, though at least some contemplated embodiments include gas lift valves that regulate the gas flow rates to reduce sensitivity to upstream pressure, downstream pressure, and/or the differential pressure. In some embodiments, the pump tubular 114 is blocked at or below CTGL coupler 133 to prevent gas flow through the end of the pump tubular. In other embodiments, the coupler 133 provides a port at the end of the tubular 114 rather than in a sidewall of the tubular.

The pump tubular is preferably continuous tubing. To provide the CTGL port sleeves 1323, 132C at desired locations as the continuous tubing is unspooled, straightened, and injected into the well, the injected portion may be secured to the well head by slips. Once secure, a hole may be drilled through the CT wall, and a sleeve attached to the tubular in a fashion that aligns the sleeve port with the drilled hole. The sleeve port may be threaded to accept orifice inserts or valves of different sizes. The chosen inserts are installed, and the slips released so that more of the tubing can be injected.

Once the pump tubular is fully inserted, a polished rod sleeve or a polished rod liner may be attached. The bridle head and cables may then be attached to suspend the pump tubular from the "horsehead" of the walking beam. The gooseneck and hose may then be connected to attach the pump tubular to the suitable inflow or outflow pipe. In some configurations, the gooseneck is replaced with an elbow or other suitable connector.

The illustrated hybrid artificial lift system operates by reciprocating the pump tubular to force fluid up to the surface through the annular flow conduit. At the same time, gas is injected via the pump tubular to create bubbles in the liquid and/or to induce slug flow, increasing flow velocity while reducing fluid density. The relative effort expended for reciprocation and for gas injection can be varied from one extreme (pumping with no gas injection) to the other (no pumping with alternate fluid accumulating and gas injection phases), though the maximum lift efficiency may be found at an intermediate point of this range. Some alternative embodiments alternate the reciprocation and gas lift, such that reciprocation is used to raise the fluid level within the flow conduit, and thereafter the gas lift is used to raise the bulk of the fluid to the surface.

FIG. 1A also shows a ball valve 134 for optionally: venting the casing annulus to maximize formation fluid inflow, pressurizing casing to "prime" the pump, and/or providing access for fluid well treatments.

FIG. 1B shows a close-up of the plunger 112 on the end of the pump tubular 114 inserted in the pump body 108 at the end of the production tubular 110. When surface pump unit 116 raises the pump tubular 114, traveling check valves 142A and 142B close, causing the plunger 112 to draw fluid into the barrel of pump body 108 via standing check valve 140. When surface pump unit 116 lowers the pump tubular 114, standing check valve 140 closes, forcing fluid through the traveling check valves 142A and 142B as the plunger 112 descends. Fluid enters the plunger through the traveling check valves and exits through ports 144 into the annular conduit between the pump tubular 114 and production tubular 110. As the reciprocation is repeated, additional fluid is drawn from the well bore and forced into the annular conduit and up to the surface.

Gas injected via the pump tubular 114 exits the port in coupler 133, mixing with the fluid in the annular conduit to reduce density and increase flow velocity. The pump tubular load (and pump stroke effort) is reduced when the fluid density is reduced, and the increased flow velocity reduces chances for deposition of asphaltenes or paraffins. In fluids having high sand volumes (e.g., post-fracking), the gas injection increases flow velocity to aid in sand removal while simultaneously reducing the pump tubular load. Where sand accumulates a gas (e.g., Nitrogen) circulation operation can be performed to flush the sand from the well. The port in coupler 133 enables circulation operations to be performed in either direction (down through bore and up through annulus, or down through annulus and up through bore). Illustrative circulating operations may include, e.g., chemical treatments for inhibiting corrosion, removing scale, and dissolving asphaltene/paraffin deposits. Another potential circulating operation is liquid or foam flushing of accumulated sand.

We note here that only one traveling check valve is required. The second traveling check valve may offer redundancy, and may further protect the first check valve during circulating operations through the pump tubular and production tubular. The travelling check valves 142A, 142B, and the standing check valve 140, are preferably ball and seat valves, though different check valve implementations are known in the literature and may be suitable for some applications. Other suitable check valve configurations, such as flapper valves, reed valves, and sliding sleeve valves, are known and may be used. The check valves open alternately in response to differential pressure in the upward direction, and close in response to differential pressure in the downward direction.

Because ports 144 create an "open" cage top for plunger 112, the weight of the fluid in the annular conduit adds downward pressure to the plunger 112, reducing the pressure drop across the traveling valves and aiding in the downstroke. The fluid weight may thus be viewed as a virtual sinker bar that maintains tension and stiffness of the pump tubular 114, further improving pumping efficiency.

FIG. 1C shows an illustrative cross section of a pump tubular 114. In at least some embodiments, pump tubular 114 has a fixed outer diameter 150 and a smoothly tapering wall thickness that varies from an upper wall thickness 152 to a lower wall thickness 154. For steel CT having an outer diameter of 1.25 inches, the upper wall thickness may be, e.g., 0.154 inches and the lower wall thickness may be, e.g., 0.109 inches. Such tapering enables significant reduction in the weight of the pump tubular 114 while preserving its strength and stiffness. Depending on system design, one or more CTGL sleeves or CTGL couplers may optionally be added at selected positions along the length of the tubular.

FIG. 2A shows a second illustrative hybrid artificial lift system. Most of the components are the same. However, in the illustrated system of FIG. 2A, the gas control unit 124 injects compressed gas via inflow pipe 130 to the annular conduit between production tubular 110 and pump tubular 114. The pump plunger 212 is configured to drive fluid to the surface via the pump tubular (i.e., the central bore conduit). Compressed gas enters the ports of CTGL couplers 133A-133C to introduce bubbles and/or slug flow along the central bore conduit, thereby increasing flow velocity and reducing density. At the surface 100, the produced fluid and gas exits the pump tubular 114 via a high pressure hose 219 to reach fixed outflow pipe 118.

To provide the CTGL couplers 133A-133C at desired locations as the continuous tubing is unspooled, straightened, and injected into the well, the injected portion may be secured to the well head by slips. Once secure, the injected portion may be severed from the spooled portion. A CTGL coupler 133 may be attached to the injected portion via a roll-on or slip-type connector, and a second roll-on or slip-type connector attaches the coupler to the spooled portion, such that the coupler reconnects the spooled portion to the injection portion while providing a sidewall port for gas injection into the fluid flow.

A roll-on connector is a hollow cylinder that has circumferential grooves on its exterior. This connector fits inside the bore of the tubing, and a tool is used to crimp the continuous tubing to the connector, thereby making the connection. Connectors of this type typically also include "O-rings" to seal the connection against leaks. Roll-on connectors advantageously do not increase the outer diameter of the coiled tubing, and thus do not require any clearance allowances downhole. A slip-type connector is a hollow cylinder that has circumferential ridges on its interior. The ridges are designed to allow the tubing to be inserted into this connector, and to then grip the exterior of the tubing to prevent it from subsequently being removed. "O-rings" are also provided in this case to seal the connector against leakage.

FIG. 2B shows a close-up of the plunger 212 positioned in the pump body 108. Rather than driving the pumped fluid into the annular conduit, reciprocation of the plunger 212 drives fluid into the central bore conduit. Again, only one traveling valve is required, but a second traveling valve may provide redundancy and more efficient cleanout operations.

FIG. 2C shows a cross section of another illustrative pump tubular 114. Rather than being smoothly tapered, the illustrated tubular has a step-tapered wall thickness. The outer diameter 150 is again fixed (except for the couplers 133). The wall-thickness 152 of the uppermost tubular may be, e.g., a fixed 0.154 inches. The wall thickness 154 of the lowermost tubular may be, e.g., a fixed 0.109 inches. The wall thickness of an intermediate tubular may be fixed at an intermediate value. The changes in wall thickness occur abruptly, e.g., at the CTGL couplers 133B and 133C. This stepped taper approach may offer similar weight savings, with tolerable losses to strength and rigidity, at a significantly reduced cost.

Once the well has entered the production phase (i.e., has begun delivering liquid to the gas separator 120), various parameters such as strokes per minute, stroke length, gas injection pressure/rate, and pause (fluid accumulation) period and duty cycle, may be adjusted to maintain a desired bottom hole liquid level or pressure. In some contemplated embodiments, the gas control unit 124 has sensors to measure the pump tubular load, gas injection rate, gas injection pressure, fluid production rate, produced fluid pressure, and produced gas/liquid fraction, and responsively adapts the various parameters to meet an optimization target such as maximizing production efficiency.

The number of CTGL sleeves or couplers is expected to vary based on various factors such as tubular dimensions, gas pressure, and port size, but for strings of up to 10,000 ft length, it is contemplated that the number of CTGL sleeves or couplers would typically be in the range of 1 to 5, inclusive.

To reduce wear and extend the useful life of the pump tubular 114, centralizers may be provided at regular intervals along its length. Alternatively (or additionally) CT rotators similar to existing rod rotators may be used to distribute wear evenly and thereby extend the useful life of the pump tubular in this manner.

The gas control unit 124 includes electronics for opening and closing valves, for acquiring measurements of fluid flow rates and pressures, and further includes a processor executing firmware or software stored in memory to coordinate the operation of the valves to control the surface pump unit and the various other well site components. Among the operations facilitated by the control unit 124 is the periodic injection of a lift gas and periodic operation of the surface pump unit to raise fluid from the well into the vertical gas separator 120. As discussed previously, the gas injection may occur concurrently with the reciprocation of the pump tubular, or they can be performed alternately. The injected lift gas is exhausted via the lift conduit and passes into the separator 120, where it may be captured and directed to an optional compressor for recycling into the form of CNG. Alternatively, or in addition, such gas may be combusted to drive a motor or generator that supplies power to the various components of the system.

Though the above-described embodiments show the pump body 108 as being positioned at the end of the production tubular 110, other configurations are also contemplated. For example, FIG. 3 shows an illustrative embodiment in which the a dip tube 302 is attached to the suction end of the pump body 108. The dip tube 302 can be made from steel or composite material, but in any event it is generally much more flexible than the pump body 108, and is thus able to extend the fluid intake 304 into deviated or tortuous sections of the well. The dip tube 302 further enables the pump tubular 114 to remain within the straighter portion of the well, thereby avoiding any increased wear and power requirement that would otherwise result from driving the pump tubular through one or more bends in the production tubular. Some contemplated dip tube embodiments are equipped with a check valve at the fluid intake 304, but this is not a requirement.

Figure 4:
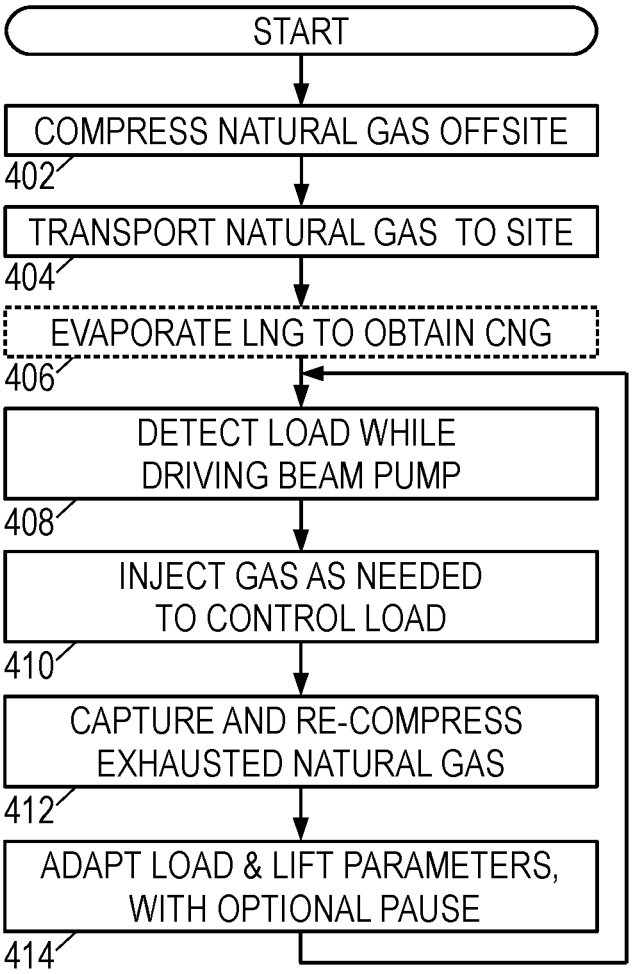
FIG. 4 is a flow diagram of an illustrative hybrid artificial lift method.

FIG. 4 is a flow diagram of an illustrative artificial lift method embodiment. It begins in block 402 with compressing natural gas at an offsite facility to fill a transport trailer with CNG or LNG. In block 404, the natural gas is transported to the well site and coupled to the gas control unit 124 to supply natural gas as needed for injecting lift gas into the well and/or powering the well site components. If the transported natural gas is LNG, the system evaporates the LNG in optional block 406 to obtain CNG. If such evaporation is performed in a confined volume, the LNG is converted directly to CNG without requiring a compressor. Alternatively, some of the gas may be combusted to power a compressor that converts the evaporated LNG into CNG.

Blocks 408-414 form a cycle that is repeatedly performed by gas control unit 124. In block 408, the controller 124 operates the surface pump unit 116 and monitors the load on the pump tubular. The load is expected to increase as the operation of the downhole plunger forces fluid up the lift conduit. As the load increases, the controller begins injecting lift gas in block 410 to control the load and optimize production efficiency. In block 412, the produced fluid separates into liquid and gas and the controller captures and compresses the gas for re-use or delivery to market.

The pumping and gas injection may continue until the pump tubular load drops, perhaps due to a fall in the level of the liquid pool at the bottom of the well. In block 414, the controller adapts the operating parameters of the system, e.g., by adjusting the stroke rate, the lift gas injection rate, and optionally pauses operations to enable further accumulation of liquid in the well. The controller may be designed to adapt the parameter values in a fashion that maximizes efficiency, profitability, or some other measure of performance, which may account for the volume of produced fluid, the volume of injected gas, production rate, and any other suitable optimization variables, to adapt parameters for the next cycle.

The foregoing embodiments may offer a number of potential advantages. With the reduction in weight from using a tapered pump tubular and injecting a lift gas, the load on the surface pumping unit may be reduced up to 50% or more, yielding a substantial energy savings compared to traditional pump rod systems. Existing beam pumping units (and other surface pump units) can continue to be employed, reducing capital investment costs. Another potential advantage is the isolation of the gas injection conduits and lift conduits from the casing, minimizing the impact of casing integrity losses in aging wells. Still further, there is no need of a packer to isolate the annular space between the casing and the production tubular. Existing gas compression infrastructure can be used, and it is expected that the gas usage of the disclosed systems will be substantially less than that used for traditional gas lift systems. The ports further enable circulation of well servicing fluids without tripping any equipment out of the hole, substantially reducing workover operations and maintenance costs.

For initial production (particularly with horizontal wells and/or post-frac operation) gas can be circulated (e.g., down the annulus and up the pump tubular bore) to remove the early production fluid, which typically includes high sand fraction. After the initial production declines, fluid can be produced either up the production tubular or up the pump tubular, depending on fluid volume. If the pump unit is operated intermittently (e.g., by an automated controller 124), gas may optionally be injected for a few minutes to reduce fluid density before the pumping unit is restarted.

Numerous other variations and modifications will become apparent to those skilled in the art once the above disclosure is fully appreciated. For example, the gas injection ports may also enable well servicing by circulating fluid to clean the bore and annular conduits and inhibit corrosion or scaling. The ensuing claims are intended to cover such variations where applicable.

I claim:

1. A well that comprises:

a pump tubular that separates an annular conduit from a central bore conduit, with one of the annular conduit and the central bore conduit serving as a lift conduit and the other of the annular conduit and the central bore conduit serving as a gas injection conduit, and with the pump tubular having at least one port for gas to flow from the gas injection conduit to the lift conduit;

a downhole pump having a plunger that is driven by reciprocating motion of the pump tubular to force a liquid flow into the lift conduit, the liquid flow receiving lift gas from the at least one port; and a gas control unit that supplies the gas to the gas injection conduit.

2. The well of claim 1, wherein the central bore conduit is the lift conduit and the annular conduit is the gas injection conduit.

3. The well of claim 1, wherein the central bore conduit is the gas injection conduit and the annular conduit is the lift conduit.

4. The well of claim 1, further comprising a production tubular within which the pump tubular reciprocates.

5. The well of claim 1, wherein the pump tubular comprises multiple continuous tubing portions connected by one or more continuous tubing gas lift couplers, each coupler providing at least one port for gas to flow from the gas injection conduit to the lift conduit.

6. The well of claim 1, wherein the at least one port comprises a hole drilled through a wall of the pump tubular with a fitting or tubing sleeve that defines a chosen orifice size for the port.

7. A hybrid artificial lift method that comprises:

anchoring a pump body downhole at the end of a production tubular in a well;

attaching a pump plunger to a pump tubular, the pump tubular having a central bore;

providing the pump tubular with one or more gas injection ports;

positioning the pump tubular within the production tubular, thereby defining an annular conduit;

reciprocating the pump tubular to drive the pump plunger within the pump body and thereby create a fluid flow to a well head via the central bore or the annular conduit; and concurrently with said reciprocating, injecting gas into the fluid flow via the one or more gas injection ports.

8. The method of claim 7, wherein the central bore conveys the fluid flow to the well head and the annular conduit conveys gas to the one or more injection ports.

9. The method of claim 7, wherein the central bore conveys gas to the one or more injection ports and the annular conduit conveys the fluid flow to the well head.

10. The method of claim 7, wherein the pump tubular comprises multiple continuous tubing portions connected by one or more continuous tubing gas lift couplers, each coupler including at least one gas injection port.

11. The method of claim 7, wherein said providing includes drilling a hole in a wall of the pump tubular and attaching a fitting or sleeve to define a chosen orifice size for the hole.

12. A well that comprises:

a production tubular terminated by a pump body anchored downhole;

a tapered continuous tubing string positioned inside the production tubular and terminated by a plunger; and a surface pump unit that reciprocates the tapered continuous tubing string to reciprocate the plunger in the pump body, thereby pumping fluid to a well head via a bore of the tapered continuous tubing string or via an annular conduit between the production tubular and the tapered continuous tubing string, wherein the fluid is pumped via the bore.

13. The well of claim 12, wherein the tapered continuous tubing string has a smoothly tapered wall thickness.

14. The well of claim 12, wherein the tapered continuous tubing string includes multiple continuous tubing portions coupled end-to-end by one or more continuous tubing couplers, each continuous tubing portion having a fixed wall thickness ordered from thicker to thinner with increasing depth.

* * * * *